United States Patent [19]

Pratt et al.

[11] Patent Number: 4,725,408

[45] Date of Patent: Feb. 16, 1988

[54] FLUID CATALYTIC CRACKING APPARATUS

[75] Inventors: Roy E. Pratt, Port Neches; Scott M. Sayles, Nederland, both of Tex.; Kerry W. Bowers, Birmingham, Ala.; Richard P. Scott, deceased, late of Groves, Tex., by Candice C. Scott, executrix

[73] Assignee: Texaco, Inc., White Plains, N.Y.

[21] Appl. No.: 884,772

[22] Filed: Aug. 19, 1986

Related U.S. Application Data

[60] Division of Ser. No. 602,632, Apr. 24, 1984, Pat. No. 4,619,758, which is a continuation of Ser. No. 396,564, Jul. 9, 1982, abandoned.

[51] Int. Cl.[4] ..... B01J 8/28

[52] U.S. Cl. ..... 422/144; 422/145; 422/146; 55/208

[58] Field of Search ..... 422/141, 142, 144–146, 422/223, 225; 208/153, 161; 585/648; 55/208

[56] References Cited

U.S. PATENT DOCUMENTS

| | | | |
|---|---|---|---|
| 2,403,375 | 7/1946 | Kassel | 422/144 |
| 2,710,827 | 6/1955 | Gornowski | 422/144 |
| 2,879,232 | 3/1959 | Malo et al. | 422/223 |
| 2,965,454 | 12/1960 | Harper | 422/144 |
| 3,825,501 | 7/1974 | Muenger | 422/146 |
| 4,310,489 | 1/1982 | Fahrig et al. | 208/161 |
| 4,356,082 | 10/1982 | Gross | 422/146 |
| 4,379,123 | 4/1983 | Davidur et al. | 422/144 |

*Primary Examiner*—David L. Lacey

*Attorney, Agent, or Firm*—Robert A. Kulason; James J. O'Loughlin

[57] ABSTRACT

Apparatus for catalytic cracking of a selected portion of a hydrocarbon feedstock comprising a riser reactor and a catalyst regenerator, a regenerated catalyst cooler, and an absorber. Regenerated catalyst from the catalyst regenerator is conducted through the catalyst cooler into the absorber where it adsorbs hydrocarbon cracking feedstock and then returned to the riser reactor. A duct carries part of the hot regenerated catalyst from the catalyst regenerator directly to the riser reactor to supply heat for cracking the hydrocarbon feedstock.

3 Claims, 1 Drawing Figure

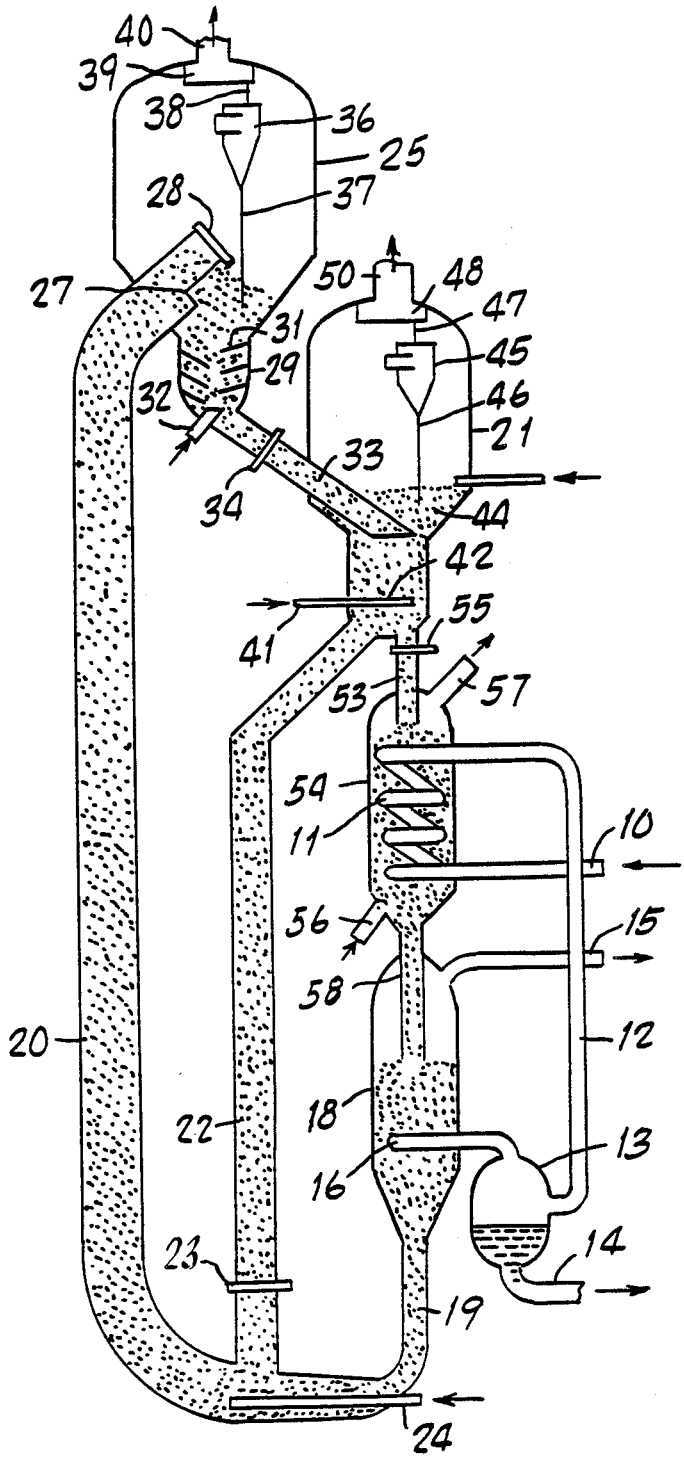
40
39
38
36
25
37
28
27
50
48
47
31
29
45
46
32
21
33
34
44
42
55
41
53
57
54
11
10
56
15
58
20
12
18
22
13
16
14
23
19
24

FLUID CATALYTIC CRACKING APPARATUS

This application is a division of application Ser. No. 602,632, filed Apr. 24, 1984, now U.S. Pat. No. 4,619,758, which was a continuation of application Ser. No. 396,564, filed July 9, 1982, now abandoned.

This invention relates to an apparatus for fluidized catalytic cracking of petroleum hydrocarbon feedstocks. In one of its more specific aspects, this invention relates to an improved apparatus for fluidized catalytic cracking of paraffinic hydrocarbons. In another of its more specific aspects this invention relates to apparatus for carrying out an improved method for cracking a selected portion of a paraffinic hydrocarbon feedstock at subatmospheric pressure. In still another of its more specific aspects, this invention relates to improved apparatus for cracking of hydrocarbon feedstocks at subatmospheric pressure.

In a preferred specific embodiment, this invention relates to an apparatus in which a paraffinic vacuum gas oil fraction suitable as chargestock for a fluid catalytic cracking unit is processed for the removal of at least a part of its paraffinic components thereby separating the hydrocarbon charge stock into a deparaffined fraction and a paraffins-containing fraction. The paraffins-containing fraction is subjected to catalytic cracking in a riser-type reaction zone at a temperature in the range of 650° to 700° C. The products of the reaction are processed for the recovery of light olefins, fuel gas, and motor fuel fractions.

In accordance with U.S. Pat. No. 4,388,176 the deparaffined fraction may be subjected to mild hydrogenation effecting saturation of its more readily hydrogenatable components and the resulting hydrotreated deparaffined fraction subjected to catalytic cracking in a riser-type fluidized catalytic cracking reaction zone at a temperature in the range of 520° to 540° C.

Fluidized catalytic conversion processes, such as fluidized catalytic cracking for the processing of petroleum fractions are well known. In a fluidized catalytic cracking process, a hydrocarbon oil feedstock is contacted with a catalyst in a reaction zone under conditions such that the hydrocarbon feedstock is converted into desired products accompanied by the deposition of coke on the surface of the catalyst particles. Such systems may comprise a transport or riser type reaction zone through which the feed hydrocarbon and a solid particulate catalyst suspended in feed hydrocarbon vapors are passed concurrently. The reaction products and catalyst are discharged from the riser reaction zone into a separation zone in which hydrocarbons and normally gaseous by products of the cracking reaction are separated from the catalyst.

Gases and hydrocarbon vapors from the separation zone may be passed to a fractionation system, for the recovery of hydrocarbon liquid fractions and separation into desired product fractions according to their boiling ranges. For example, liquid hydrocarbons recovered from the product effluent from a fluidized catalytic cracking unit may be separated into a gasoline and lighter components fraction, a light cycle gas oil fraction, an intermediate cycle gas oil fraction, and a heavy cycle gas oil bottoms, or residual, fraction. Gases produced in the cracking reactions comprise hydrogen which may be recovered and utilized in the hydrogenation step in the process of this invention.

The yield of desirable products from a fluidized catalytic cracking process may be controlled within certain limits by selecting the charge stock, the catalyst, hydrocarbon conversion conditions within the reaction zone, i.e., the temperature, pressure and catalyst-oil contact time, the catalyst-to-oil ratio, etc.

In a riser reactor, as the mixture of catalyst and hydrocarbon vapors passes upwardly through the reaction zone, the catalyst and products are cooled by endothermic cracking reactions. In such systems, the reaction temperature may be expressed in terms of an average temperature in the reactor or as the temperature at the outlet of the riser reactor. During its passage through the reaction zone the catalyst becomes partially deactivated due to the deposition of coke thereon and is referred to as "spent" catalyst as contrasted with regenerated or "fresh" catalyst. The spent catalyst from the reaction zone may be regenerated by reaction with oxygen or air.

In the usual procedure, spent catalyst from the reaction zone is contacted in a stripping zone with a gaseous stripping medium, usually steam, to remove vaporizable entrained and occluded hydrocarbons from the catalyst. From the stripping zone, stripped catalyst may be passed into a regeneration zone where it is regenerated by burning coke deposits therefrom with an oxygen-containing gas, usually air. Regeneration of cracking catalysts takes place at elevated temperatures in the range of 600° to 750° C.; with the newer zeolite catalysts, regeneration temperatures are preferably in the range of 695° to 730° C. The resulting hot regenerated catalyst from the regeneration zone is supplied to the lower end of the riser reaction zone into contact with the hydrocarbon feedstock as cataslyst for the desired cracking reactions and as a source of heat to vaporize and crack the hydrocarbon chargestock.

In a preferred form of this invention, there is provided an improved process for catalytically cracking a parafinic hydrocarbon feed in which the feedstock is separated into two fractions, one highly paraffinic and the other more naphthenic and aromatic in nature, and each fraction separately processed. The paraffinic fraction is cracked in the presence of zeolite serving the dual purpose of a fluid catalytic cracking catalyst and a molecular sieve for separating paraffins from non-paraffins. The dual purpose zeolite passes through an adsorption zone where it contacts a vaporized portion of the charge stock, e.g. paraffinic vacuum gas oil and then the loaded sieve with its adsorbed paraffins is charged to a riser type catalytic cracking reactor where the paraffins are desorbed and converted to lower molecular weight hydrocarbons in the presence of the zeolite as catalyst. The contact time between the hydrocarbon feedstock and the catalyst is limited to not more than two seconds; the contact time is preferably within the range of from about 0.2 to about 1 second.

Separation of straight chain paraffin hydrocarbons from vapor phase mixtures containing both straight chain and non-straight chain hydrocarbons by adsorption on an aluminosilicate molecular sieve selective adsorbent is known from U.S. Pat. Nos. 3,373,103 and 3,523,075, for example, incorporated herein by reference. Such processes are well known in the art and need not be described in detail herein. Suitable solid adsorbents for straight chain hydrocarbons, include H-mordenites, erionite, Y, X, K, Kt, and A zeolites, and include calcium aluminosilicates marketed under the tradename Line Molecular Sieve Type 5A or 5A-45 having pore size or opening in the range of about 4 to 5 angstrom units as well as larger pore zeolites. The pore size must be sufficiently large to admit straight chain hydrocarbons, such as normal paraffins and normal olefins, in preference to nonstraight chain hydrocarbons, particularly naphthenic and aromatic hydrocarbons.

Adsorption is carried out in the vapor phase at an elevated temperature by passing the mixed hydrocarbon vapors over a bed of the zeolite, usually at superatmospheric pressure. It is preferable to carry out the adsorption step at a temperature above the dew point of the vaporized feedstream to minimize surface adsorption of the non-paraffinic hydrocarbons on the selective adsorbent and to minimize the holdup of the charge stock in the interstices of the molecular sieve particles. Usually, the adsorber temperature is kept below that of which cracking of the charge stock occurs. Temperatures in the range of 300° to 360° C. in the absorption step are satisfactory. The pressure of the adsorption step may vary depending upon the nature of the feedstock and the extent of adsorption of the normal paraffins desired. Conventionally, the adsorber is operated at a pressure in the range of 1.08 bar to 4.5 bar. In accordance with the present invention, the adsorption step is operated at a pressure of about 0.7 bar and at a temperature in the range of 315° to 400° C.

In conventional processes for the separation of normal paraffins from hydrocarbon mixtures, desorption of the hydrocarbons from the molecular sieve is carried out at a pressure lower than the adsorption pressure, i.e. usually in the range of 1 to 1.8 bar and a suitable purge gas is introduced into the adsorption vessel in a direction opposite the direction of flow of the charge stock during the adsorption step. Desorption is usually terminated when 25 to 80 percent of the adsorbed hydrocarbons have been displaced from the molecular sieve adsorbent. The desorbed molecular sieve is then reused for adsorption of additional amounts of paraffin hydrocarbons. Regeneration of the adsorbent to restore its activity after prolonged use in the process may be necessary; methods for the regeneration of molecular sieve adsorbents are known in the art, for example, U.S. Pat. No. 2,908,639.

In the process of this invention the loaded molecular sieve, i.e. molecular sieve having paraffin hydrocarbons adsorbed in its cell structure, is withdrawn from the adsorption zone and subjected to temperatures effective for the catalytic conversion of its hydrocarbon content to products of lower molecular weight, i.e. cracking conditions. The effectiveness of small pore alumino-silicate zeolites of the ZSM-5 type as cracking catalysts is known from U.S. Pat. Nos. 3,702,886; 3,755,145; and 3,759,821 incorporated herein by reference.

The single FIGURE of the drawing is a diagrammatic representation of a preferred form of apparatus forming a part of the present invention and particularly adapted to carrying out the process of this invention.

With reference to the drawing, hydrocarbon feedstock, for example, vacuum gas oil from a paraffin base crude oil is supplied to the process through line 10 to heater 11 where it is heated by indirect heat exchange with hot regenerated catalyst from a catalyst regeneration zone, described hereinafter, to a temperature in the range of 260° to 400° C., preferably 340° to 370° C. and discharged through line 12 to feed flash drum 13 maintained at subatmospheric pressure, preferably about 0.5 bar. Typically, the charge stock will comprise a vacuum gas oil having a true atmospheric boiling range of from about 230° to about 565° C. with a 50 percent point of about 395° to 400° C. A portion of the hydrocarbon feedstock is vaporized in heater 11 and in feed flash drum 13 where separation of vapors from unvaporized oil takes place. The unvaporized portion of the hydrocarbon feedstock is discharged from feed flash drum 13 through line 14 and is suitable as charge stock to a conventional fluid catalytic cracking unit, not illustrated.

Hydrocarbon vapors separated from unvaporized oil in flash drum 13 are introduced into the lower portion of a downwardly moving bed of a molecular sieve alumino-silicate zeolite contained in adsorber vessel 18. As the hydrocarbon vapor passes upwardly through the bed of molecular sieve adsorbent contained in adsorber 18, the normal paraffins are selectively adsorbed by the molecular sieve. Molecular sieve loaded with adsorbed paraffins is withdrawn from adsorber vessel 18 through standpipe 19 into the lower end of a conduit 20 comprising a riser reactor where it is mixed with freshly regenerated molecular sieve catalyst from catalyst regenerator 21 via standpipe 22 at a rate controlled by slide valve 23. Dispersion steam a naphtha recycle stream or both, are introduced through line 24 into the lower part of riser reactor 20 as carrier for the loaded molecular sieve catalyst from standpipe 19 and hot freshly regenerated catalyst from standpipe 22. Adsorbed paraffins are desorbed from the molecular sieve under the temperature and pressure conditions prevailing in riser reactor 20. The resulting mixture of catalyst and oil vapors optionally mixed also with steam passes upwardly through riser reactor 20 and is discharged into separator 25.

Regenerated catalyst introduced into the lower end of riser reactor 20 from standpipe 22, preferably has a carbon content less than 0.3 weight percent and is withdrawn from regenerator 21 at a temperature in the range of about 700° to 800° C., preferably about 760° C. The dispersion steam or hydrocarbon recycle streams supplied through line 24 is preferably preheated to a temperature in the range of 480° to 540° C. The temperature in riser reactor is maintained in the range of 650° to 700° C., preferably about 675° to 680° C. by hot regenerated catalyst from standpipe 22. The reactor is operated at a pressure within the range of 0.3 to 0.6 bar, preferably about 0.5 bar. The residence time in reactor 20 may range from about 0.1 to 2 seconds.

A mixture of gasiform hydrocarbons and catalyst suspended therein passes upwardly through riser reactor 20, suitably at an average superficial gas velocity in the range of from about 40 to about 60 feet per second and at a temperature of about 680° C. Desorption of paraffin hydrocarbons from the molecular sieve catalyst, accompanied by cracking and reforming of the hydrocarbons takes place in the riser reactor. The resulting mixture of reaction products and catalyst from riser reactor 20 is discharged into separator 25 wherein catalyst is separated from the hydrocarbon gases and vapors. Separator 25 comprises a closed vessel into which the catalyst and reaction products from riser reactor 20 are directed downwardly by a deflection plate 28 at the upper end of riser reactor conduit 20.

Normal paraffins adsorbed by the molecular sieve in adsorber vessel 18 are introduced into riser reactor 20 while still adsorbed on the molecular sieve at a temperature of about 400° C. Heat for desorbing and cracking the adsorbed paraffins is provided by regenerated catalyst supplied to the riser reactor at a temperature of about 760° C. The combination of high temperature, short residence time, and subatmospheric pressure in the riser 20 favors high yields of gaseous olefins, particularly $C_2$ to $C_4$ olefins, together with a comparable amount of methane and ethane. Products and catalyst discharged from the upper end of riser reactor 20 into separator 25 are immediately separated from one another effectively terminating the hydrocarbon conversion reactions.

Preferred reaction conditions in riser reactor 20 include a catalyst-to-oil weight ratio in the range of 5 to 10 and a weight hourly space velocity in the range of about 60 to 100. The vapor velocity in riser 20 is suitably within the range of 20 to 60 feet per second. The riser is of such length that the average residence time of the hydrocarbons is within the range of 0.1 to 2 seconds, preferably 0.5 to 1 second.

The adsorption of paraffins by the molecular sieve in vessel 18 is carried out with a mixture of 5A zeolite and mordenite which is suitable not only as a molecular sieve adsorbent, but also as a cracking catalyst. The effectiveness of small pore aluminosilicate zeolites as cracking catalysts is known, for example, from U.S. Pat. No. 3,759,821.

Catalyst separated from the hydrocarbon product vapors and gases in separator vessel 25 collects in the lower portion of vessel 25 from which it flows downwardly through a conventional catalyst stripper 29. Catalyst stripper 29 contains baffles 31 to ensure good contact between the catalyst and stripping steam supplied through line 32. Volatile hydrocarbons are stripped from the spent catalyst in stripper 29 and the stripped catalyst is introduced into fluidized bed regeneration zone 21 through standpipe 33 as controlled by slide valve 34.

Stripping steam from line 32 rises through stripper 29 removing occluded and entrained hydrocarbons from the catalyst. The steam and displaced hydrocarbon vapors pass upwardly through the dense phase fluidized bed of catalyst in the stripper and are disengaged from the catalyst at the upper level of the dense phase bed which preferably is maintained just below outlet 27 of riser reactor 20. Vessel 25 preferably has an enlarged cross-sectional area relative to that of stripper 29, as illustrated. The gas velocity in the upper section of vessel 25 is relatively low to facilitate separation of catalyst particles from hydrocarbon vapors and steam. Catalyst which separates from the steam and hydrocarbon vapors in separator 25 falls by gravity into stripper 29.

Some of the catalyst particles remain in the vapor stream discharged from separator 25, and this mixture of hydrocarbon vapors, steam and entrained catalyst enters cyclone separator 36 contained in vessel 25. Separator 36 removes all but the smallest particles of entrained catalyst from the steam and hydrocarbon vapors. Catalyst recovered from the vapor stream in separator 36 is returned to the catalyst stripper through dipleg 37. Although only one cyclone separator is illustrated in the drawing, it will be understood that several such separators may be assembled in parallel and in series to achieve substantially complete separation of all but the smallest particles of catalyst from the mixture of hydrocarbon vapors and steam and that a plurality of such assemblies may be employed to handle the relatively large volume of vapor which is normally present during operation of the process.

Effluent vapors from separator 36 pass through line 38 into plenum chamber 39 where vapors from other cyclone assemblies, not shown, are collected. The product vapors are discharged from plenum 39 through line 40 to product recovery.

A suitable compressor not illustrated, may be employed to maintain subatmospheric pressure in reactor 20 and separator 40 in known manner.

In regenerator 21, a dense phase fluidized bed of spent catalyst from stripper 29 is contacted with regeneration air introduced through line 41 to air distributor ring 42 constructed and arranged to inject air radially into admixture with catalyst. Oxygen from the air burns accumulated coke from the catalyst thereby regenerating the catalyst. Catalyst undergoing regeneration forms a dense phase fluidized bed 44 in the lower part of regeneration zone 21 with an upper bed level just above the discharge end of standpipe 33, as illustrated.

Flue gases, comprising nitrogen, carbon dioxide and steam, and containing from 1 to 10 mole percent excess oxygen and generally less than about 200 parts by million carbon monoxide are passed through cyclone separator 45 in regenerator vessel 21. Finely divided entrained solid particles are separated from the gas stream in separator 45 and returned by dipleg 46 to the dense phase catalyst bed 44. The cyclone separator 45, although represented as a single unit, may comprise an assembly of cyclone separators arranged in parallel and in series to remove all except the finest particles of catalyst from the flue gas mixture. The gaseous effluent from cyclone separator 45 passes through line 47 into plenum 48 from which it is discharged through flue gas vent line 50 which may be provided with a steam jet evacuator, not illustrated, to maintain subatmospheric pressure in separator 45 and regenerator vessel 21.

Regenerated catalyst is withdrawn from the bottom of regenerator 21; part of the withdrawn catalyst passes through standpipe 22 as controlled by slide valve 23, previously described, to supply the hot regenerated catalyst to riser reactor 20. A further portion of the regenerated catalyst withdrawn from regenerator 21 passes through standpipe 53 into heat exchange vessel 54 at a rate controlled by slide valve 55. Nitrogen is introduced into the lower portion of vessel 54 through line 56 for fluidization of catalyst within vessel 54 and is discharged through line 57.

Hydrocarbon charge stock from line 10 passes through heater 11, immersed in the catalyst in vessel 54 and is heated by indirect heat exchange with the regenerated catalyst. Catalyst enters vessel 54 from standpipe 53 at the regenerator bed temperature, which preferably is of the order of 740° to 760° C. and is cooled by heat exchange with the hydrocarbon feedstock to a temperature of about 425° C. Cooled catalyst is withdrawn from the lower part of vessel 54 through standpipe 58 into adsorber 18 wherein a downwardly moving bed of catalyst is contacted with vapors from flash drum 13 to effect separation of paraffinic components of the vaporized portion of the feedstock from the non-paraffinic hydrocarbons. Non-paraffinic hydrocarbons are discharged from adsorber 18 through line 15 and may be combined with unvaporized oil from line 14 as charge stock to a second fluid catalytic cracking unit, not illustrated.

Suitable cracking catalysts for use in the process of this invention are small pore catalysts commonly referred to as "zeolite" or "molecular sieve" cracking catalysts or mixtures of small pore (4 to 5+Å) and large pore (8–10 Å) zeolites. Such catalyst are referred to herein as zeolite catalyses. Typic 1 zeolite cracking catalysts comprise about 96–85 weight percent of an amorphous refractory metal oxide matrix, and about 5–15 weight percent crystalline aluminosilicate zeolite (or molecular sieves) having uniform crystalline pore openings. The matrix generally has substantial cracking activity and is selected from naturally occuring clays, and mixtures of oxides, e.g. silica-alumina, silica magnesia, silica-zirconia, etc. The zeolite portion of such zeolite cracking catalysts comprises small particles of either natural or synthetic crystalline, X-type or Y-type aluminosilicate zeolites having a major portion of their sodium content replaced by ion exchange with one or more of the elements magnesium, rare earths, hydrogen, and other divalent and polyvalent ions which enhance the activity of the catalyst. Zeolite cracking catalysts may contain a small amount of one or more platinum group metals which catalyze the combustion of carbon monoxide to carbon dioxide at temperature commonly employed in the regeneration of cracking catalysts.

Spent cracking catalyst as described herein, usually contains from about 0.5 weight percent to about 2 weight percent coke. In regenerating the spent catalysts, by burning coke from the catalyst to restore its catalytic activity, most zeolite catalysts may be subjected to temperatures somewhat above 720° C. without substantially degrading their catalytic activity. At temperatures above about 815° C., the structure and/or composition of the zeolite may be affected in such a way that the catalyst irreversibly loses at least a portion of its catalytic activity.

Generally, the regenerating gas is air, although other regeneration gases containing molecular oxygen, such as oxygen-enriched air, and steam and air mixtures may also be employed. The degree of regeneration of catalytic activity of a spent cracking catalyst is proportional to the degree of removal of coke from the catalyst. Lower residual carbon content of regenerated catalyst results in higher regenerated catalyst activity. The catalytic activity of a zeolite cracking catalyst is more sensitive to its residual carbon content than that of an amorphous cracking catalyst. Preferably, the residual carbon content of the regenerated catalyst is reduced to about 0.1 weight percent or less. Hydrocarbon charge stocks within contemplation of the present invention are those which may be cracked to yield useful lower molecular weight hydrocarbon products. Examples of paraffinic hydrocarbon charge stocks include virgin gas-oils, vacuum gas oils, atmospheric residua, topped crude oils, and virgin naphthas.

In the process of the present invention, spent cracking catalyst containing about 0.5 to 2.0 weight percent coke is contacted with regeneration gas in a regeneration zone in an amount sufficient to provide 3 to 10 percent oxygen in excess of the stoichometric amount of molecular oxygen required for complete combustion of coke on the spent catalyst to carbon dioxide and water. Spent catalyst entering the regeneration zone is at a temperature in the range of about 550° to 600° C., and regeneration gas entering the first regeneration zone is at a temperature in the range of about 40° to 320° C. The average residence time of spent catalyst in the regeneration zone is within the range of about 10 seconds to 1 minute.

The superficial gas velocity of regeneration gas upwardly through the dense phase bed is in the range of about 0.3 to 2 m/sec; catalyst residence time in the dense phase bed, in the range of 3 to 20 minutes; and the specific coke burning rate, based on the inventory of catalyst in the dense phase bed, in the range of about 0.05 to 1.0 kg of coke per hour per kg of catalyst. Under these regeneration conditions, residual carbon on regenerated catalyst may be reduced to 0.1 weight percent or preferably 0.05 weight percent or less.

Spent regeneration flue gas comprising nitrogen, carbon dioxide, steam, and 3 to 10 mol percent oxygen, with a small amount of catalyst entrained therein, disengages from the upper surface of the fluidized dense phase catalyst bed into the upper part of the regeneration where the cross-sectional area of the regenerator preferably is increased such that the superficial vapor velocity of the spent regeneration gas decreases to a value in the range of 0.1 to about 1 m/sec. Density of this dilute phase of catalyst suspended in spent regeneration gas is in the range of about 2 to 16 kilograms per cubic meter. Upon decreasing the superficial vapor velocity of spent regeneration gas within the transition zone, substantial amounts entrained catalyst return, under the influence of gravity, to the top of the dense phase fluidized catalyst bed.

The ratio of carbon dioxide to carbon monoxide in spent regeneration gas may vary from about 1 to about 500 or more depending upon operating conditions within the fluidized dense phase bed catalyst regenerator. As carbon monoxide is a serious air pollutant, it is desirable that as much as possible be burned to carbon dioxide within the regeneration vessel. With unpromoted zeolite cracking catalyst, increased temperatures in the dense phase fluidized catalyst bed, result in increased combustion of carbon monoxide to carbon dioxide such that at about 745° C., the carbon monoxide content of the spent regeneration gas leaving the dense phase bed is less than 0.1 mole percent. When a catalyst containing a platinum group metal carbon monoxide combustion promoter is employed, essentially complete combustion of carbon monoxide to carbon dioxide may be obtained at substantially lower temperatures, of the order of about 675° C.

EXAMPLE

As an example as a specific preferred embodiment of the method of the present invention, a vacuum gas oil from a paraffin base (Berri) crude oil having the physical properties shown in Table I is heated to 395° C. at a pressure of 0.8 bar vaporizing approximately half the feedstock. The resulting vapors at 395° C. are contacted at a pressure of 0.7 bar with Linde 5A Molecular Sieve at a temperature of 425° C. and a catalyst-to-oil weight ratio of 3.

TABLE 1

| Berri Vacuum Gas Oil | |
|---|---|
| Gravity, °API | 27.7 |
| UOP K Factor | 11.91 |
| Conradson Carbon Residue | 0.19 |
| Sulfur, wt. % | 1.52 |
| Basic Nitrogen, wppm | 293 |
| ASTM Distillation (D1160) | |
| 50% point, °C. | 397 |
| Carbon Type Analysis | |
| Aromatic, wt. % | 17.9 |
| Naphthenes, wt. % | 15.9 |
| Paraffins, wt. % | 66.9 |
| Mass Spectrometer Analysis | |
| Aromatics, wt. % | 43.7 |
| Paraffins, wt. % | 26.2 |
| Naphthenes, wt. % | 28.3 |
| Molecular Weight | 351 |

Approximately 50 percent of the vaporized hydrocarbon is adsorbed by the molecular sieve and subjected to fluid catalytic cracking in a riser reactor at a pressure of 0.5 bar. An equal amount of freshly regenerated catalyst is mixed with the loaded molecular sieve supplied to the riser reactor thereby increasing the catalyst-to-oil weight ratio to about 12 in the riser reactor and maintaining an average temperature in the reactor of the order of 675° C. Results are shown in Table II.

TABLE II

| Yields - High Temperature FCCU Straight Paraffin Feedstock | |
|---|---|
| Reactor Temperature | 680 |
| Reactor Pressure, bar | 0.48 |
| Yields, wt % | |
| Hydrogen | 0.9 |
| Methane | 16.1 |
| Ethane | 18.9 |
| Ethylene | 9.0 |
| Propane | 1.7 |
| Propylenes | 16.7 |
| Isobutane | 1.0 |
| N—Butane | 0.1 |
| Butylenes | 8.1 |
| Coke | 6.4 |
| Total DB Naphtha | 19.0 |
| Research Octane | 85 |
| Motor Octane | 75 |
| API Gravity | 54 |
| Total Gas Oil | 2.1 |

It will be seen from the above example that the method of this invention provides high yields of $C_2$ to $C_4$ olefins suitable as petrochemicals feedstocks.

We claim:

1. In a fluidized catalytic cracking apparatus which comprises a riser reactor, a catalyst regenerator, means for transferring regenerated catalyst from the catalyst regenerator directly into the riser reactor, and means for transferring spent catalyst from the riser reactor into the catalyst regenerator, the improvement which comprises an adsorber, a catalyst cooler, means for transferring regenerated catalyst from said catalyst regenerator into said catalyst cooler, means for transferring catalyst from said catalyst cooler into said adsorber, means for introducing vaporized hydrocarbon cracking feedstock into said adsorber, means for discharging unadsorbed hydrocarbons from said adsorber, and means for transferring catalyst containing adsorbed hydrocarbons from said adsorber to said riser reactor as a source of feedstock and catalyst for said catalytic cracking reactor.

2. In a fluidized catalytic cracking apparatus which comprises a riser reactor, a catalyst regenerator, means for transferring regenerated catalyst from said catalyst regenerator directly into said riser reactor, and means for transferring spent catalyst from said riser reactor into said catalyst regenerator, the improvement which comprises an adsorber, a catalyst cooler, means for transferring regenerated catalyst from said catalyst regenerator into said catalyst cooler, means for transferring catalyst from said catalyst cooler into said absorber, means for introducing vaporized hydrocarbon cracking feedstock into said adsorber, means for discharging unadsorbed hydrocarbons from said adsorber, and means for transferring catalyst containing adsorbed hydrocarbons from said adsorber to said riser reactor wherein said cooling means comprises a heat exchange element constructed so as to effect indirect heat exchange between hot regenerated catalyst from said regenerator and a liquid hydrocarbon cracking feedstock, and a vapor-liquid separator in flow communication with said heat exchange element so as to receive the liquid hydrocarbon cracking feedstock and including means for transferring separated hydrocarbon vapors from said separator to said absorber.

3. Apparatus according to claim 2 wherein said catalyst cooling means comprises a vertical cylindrical heat exchanger vessel containing said heat exchange element and provided with means for introducing a fluidizing gas into a lower portion of said heat exchanger vessel and for discharging the fluidizing gas from an upper portion of said heat exchange vessel.

* * * * *